US005564850A

United States Patent [19]

Nagaoka

[11] Patent Number: 5,564,850

[45] Date of Patent: Oct. 15, 1996

[54] INPUT PEN WITH ATTACHED WRITING IMPLEMENT

[75] Inventor: Toshimasa Nagaoka, Odawara, Japan

[73] Assignee: Pilot Precision Kabushiki Kaisha, Kanagawa-Ken, Japan

[21] Appl. No.: 438,444

[22] Filed: May 10, 1995

[30] Foreign Application Priority Data

May 23, 1994 [JP] Japan ..... 6-132538

[51] Int. Cl.[6] ..... B43K 29/00; B43K 9/00

[52] U.S. Cl. ..... 401/37; 401/34; 401/195; 401/202; 401/209; 401/213

[58] Field of Search ..... 401/202, 34, 213, 401/195, 37, 209

[56] References Cited

U.S. PATENT DOCUMENTS

| | | | |
|---|---|---|---|
| 3,221,360 | 12/1965 | Seeman | 401/202 X |
| 4,509,875 | 4/1985 | Shintani | 401/34 |

FOREIGN PATENT DOCUMENTS

| | | | |
|---|---|---|---|
| 640630 | 7/1928 | France | 401/34 |
| 1014552 | 6/1952 | France | 401/34 |
| 2494637 | 5/1982 | France | 401/34 |
| 182874 | 3/1963 | Sweden | 401/34 |

*Primary Examiner*—Steven A. Bratlie
*Attorney, Agent, or Firm*—Ladas & Parry

[57] ABSTRACT

A writing instrument with an input member for pressure-sensitive handwriting at one end, and a removable writing pen on the opposite end of a cylindrical body. A single cap of a diameter smaller than that of the cylindrical body may cover either the writing pen or the input member. The diameter of the cap is smaller that the diameter of the cylindrical body to lessen the chance of it being inadvertently dislodged.

8 Claims, 4 Drawing Sheets

INPUT PEN WITH ATTACHED WRITING IMPLEMENT

BACKGROUND OF THE INVENTION

The present invention relates to an input pen with attached writing implement which is used in a pressure-sensitive handwriting input device.

An input pen with attached writing implement is known in the prior art wherein a writing implement is provided in a rear portion of the input pen and a cap of a diameter slightly larger than that of the cylindrical body is provided to cover this writing implement.

However, since the cap of this input pen with attached writing implement is removed when the writing implement is used, the cap can easily become lost. It is also likely that the cap will come into contact with other objects while it is being carried, and be removed thereby.

SUMMARY OF THE INVENTION

An objective of the present invention is to provide an input pen with attached writing implement that solves the above-described problems.

In accordance with the present invention, an input member is affixed in a front portion of a cylindrical body and a tip portion of this input member protrudes from a front end of the cylindrical body. A fixing member is affixed within a rear portion of the cylindrical body and a writing implement such as a ball-point pen is removably mounted in this fixing member. A tip portion of the writing implement protrudes a suitable amount from a rear end of the cylindrical body. A cap of a diameter smaller than that of the cylindrical body removably engages with the writing implement or the inside of the rear portion of the cylindrical body, with the configuration being such that this cap can also engage with the input member or the inside of the front portion of the cylindrical body.

When the input pen is being used, the cap is engaged with the writing implement or the inside of the rear portion of the cylindrical body to cover the writing implement, and when the writing implement is being used, the cap is engaged with the input member or the inside of the front portion of the cylindrical body to cover the input member. Thus there is no likelihood of the cap becoming lost.

In addition, since the cap is formed to have a diameter smaller than that of the cylindrical body, there is no need to worry about it coming into contact with other objects and being removed thereby.

DESCRIPTION OF THE PREFERRED EMBODIMENTS

Figure 1:
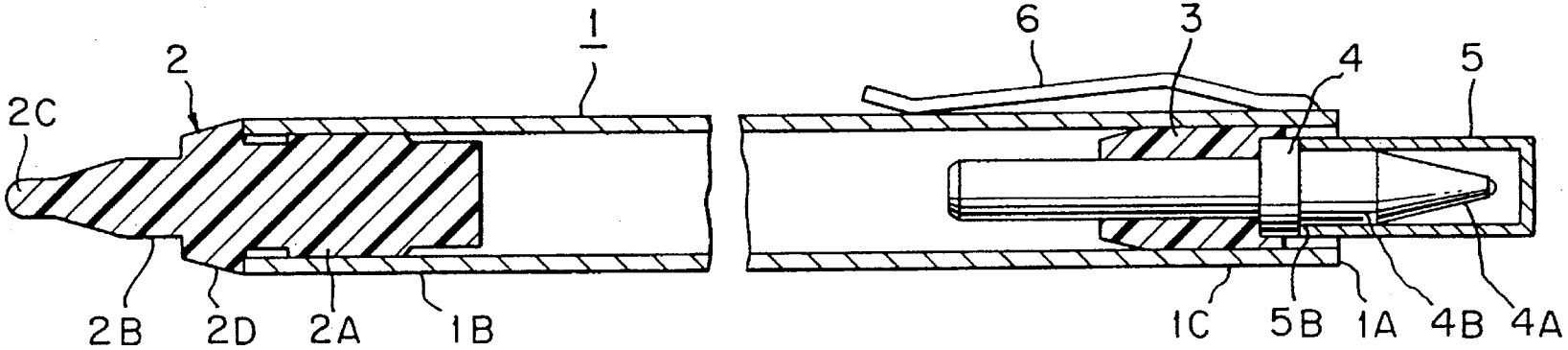
FIG. 1 is a longitudinal sectional view of an input pen with attached writing implement of the present invention.
Figure 3:
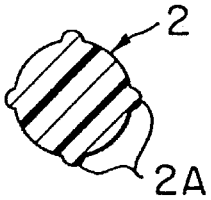
FIG. 3 is a cross-sectional view taken along the line III—III of FIG. 2.
Figure 2:
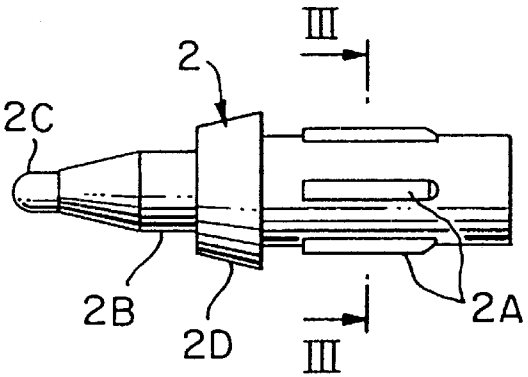
FIG. 2 is a side view of an input member of the input pen with attached writing implement of FIG. 1.

An embodiment of the present invention is shown in FIG. 1. This embodiment has a cylindrical body 1 formed in a pipe shape and of a metal such as stainless steel. An input member 2 made of a plastic material such as nylon is pushed into and affixed to a front portion of the cylindrical body 1. More specifically, as shown in FIGS. 2 and 3, four protruding ridges 2A extending longitudinally along a rear portion of the input member 2 are formed equidistantly in the circular peripheral direction thereof. A front portion 2B of the input member 2 has an input tip 2C, and a connecting flange 2D is formed in a central portion of the input member 2. The rear portion of the input member 2 is inserted through the front end of the cylindrical body 1 so that the protruding ridges 2A are pushed against the inner surface of the cylindrical body 1, and the input member 2 is fixed in a state wherein the flange 2D thereof is in contact with the front end of the cylindrical body 1. The input tip 2C of the input member 2 is formed in an approximate cone shape with a partially spherical surface of a radius of 0.75 mm formed at the tip thereof. Setting the radius of this spherical surface formed at the tip of the input member 2 to approximately 0.75 mm is optimal for ensuring that the pressure-sensitive device is not damaged, while still enabling detailed input operations.

Figure 4:
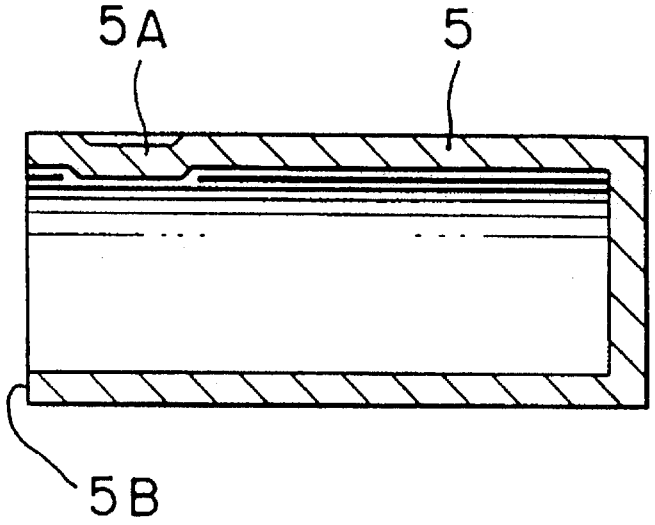
FIG. 4 is a sectional view of a cap of the input pen with attached writing implement of FIG. 1.
Figure 6:
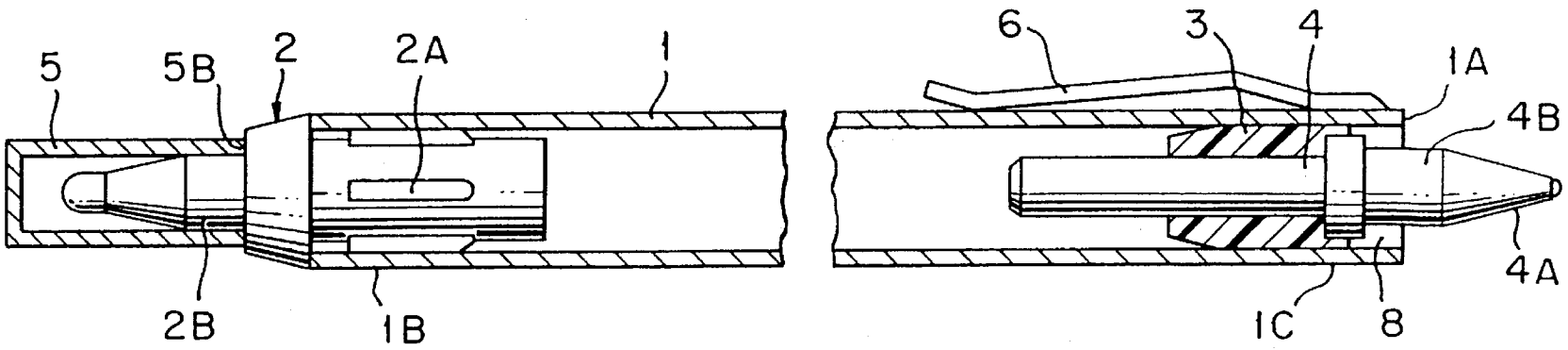
FIG. 6 is a longitudinal sectional view of the input pen with attached writing implement of FIG. 1, showing a state in which a ball-point pen is used.

A circular cylindrical fixing member 3 made of a plastic or metal material is pushed into and affixed to a rearward inner portion of the cylindrical body 1, and a base portion of a ball-point pen 4 is removably mounted in the fixing member 3. A writing portion 4A of this ball-point pen 4 protrudes by a suitable amount from the rear end of the cylindrical body 1. A cap 5 of a diameter smaller than the outer diameter of the cylindrical body 1 is engaged with an engagement portion 4B of the ball-point pen 4 so that the writing portion 4A of the ball-point pen 4 is covered thereby. The cap 5 is formed with a protrusion 5A protruding from an inner side thereof, as shown in FIG. 4, and this protrusion 5A comes into contact and engages with a peripheral surface of the engagement portion 4B of the ball-point pen 4. As shown in FIG. 6, an annular indented space 8 is formed between the inner surface of the rear end of the cylindrical body 1 and the engagement portion 4B.

Figure 5:
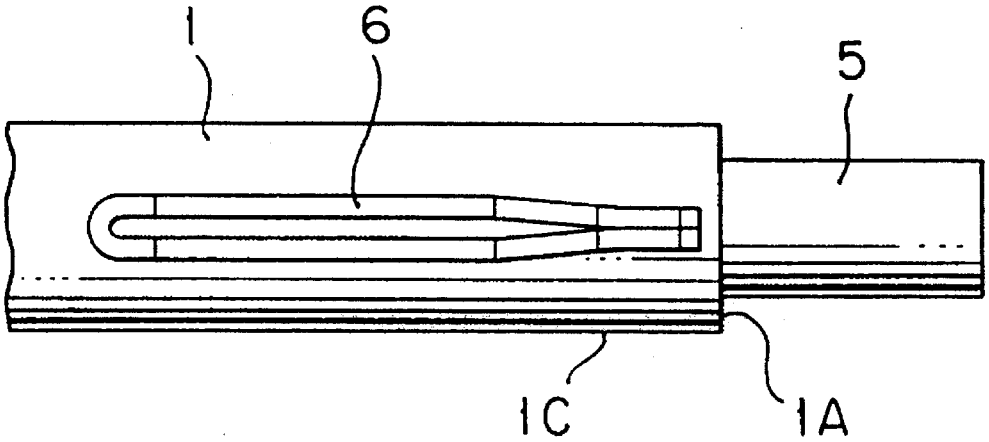
FIG. 5 is a plan view of the main components of a clip of the input pen with attached writing implement of FIG. 1.

A clip 6 formed of bent wire is attached by spot-welding to a rear portion of the cylindrical body 1, as shown in FIG. 5. To use the ball-point pen 4, the user removes the cap 5 from the engagement portion 4B of the ball-point pen 4 and places it on the front portion 2B of the input member 2, as shown in FIG. 6.

With the above-described input pen with attached writing implement, an end surface 5B of the cap 5 enters the indented space 8 at a rear end 1A of the cylindrical body 1 and thus is inserted further inward than the rear end of the cylindrical body, so that the end surface 5B of the cap 5 does not come into contact with other objects and thus there is absolutely no need to worry about it being removed thereby. In addition, since the cap 5 can engage with either the input member 2 or the ball-point pen 4, there is no necessity to provide a step or protrusion for engaging the cap 5 in a forward outer peripheral surface 1B or a rearward outer peripheral surface 1C of the cylindrical body 1, and therefore the user finds the pen easy to hold when holding either the forward outer peripheral surface 1B or the rearward outer peripheral surface 1C of the cylindrical body 1 in order to use the input pen or the ball-point pen 4. Fabricating the cylindrical body 1 of stainless steel and in a pipe form, and making the diameter of the cap 5 smaller than that of the cylindrical body 1, has the advantage of providing a portable, conveniently slim-bodied input pen with attached writing implement.

Figure 7:
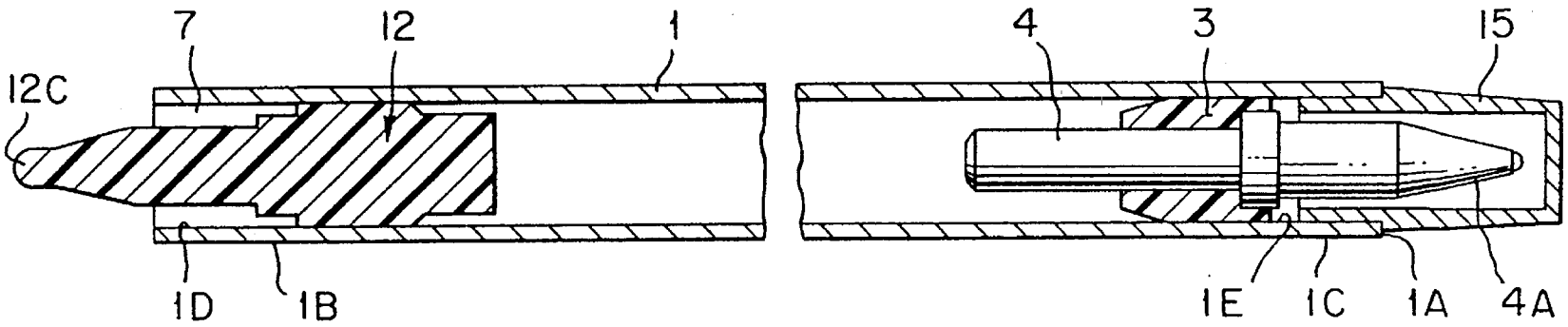
FIG. 7 is a longitudinal sectional view of another embodiment of the present invention.
Figure 8:
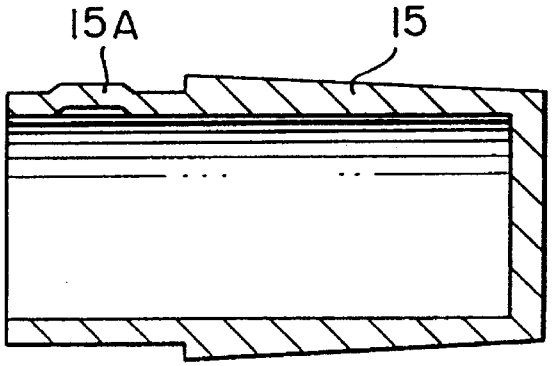
FIG. 8 is a is a sectional view of a cap of the input pen with attached writing implement of FIG. 7.
Figure 9:
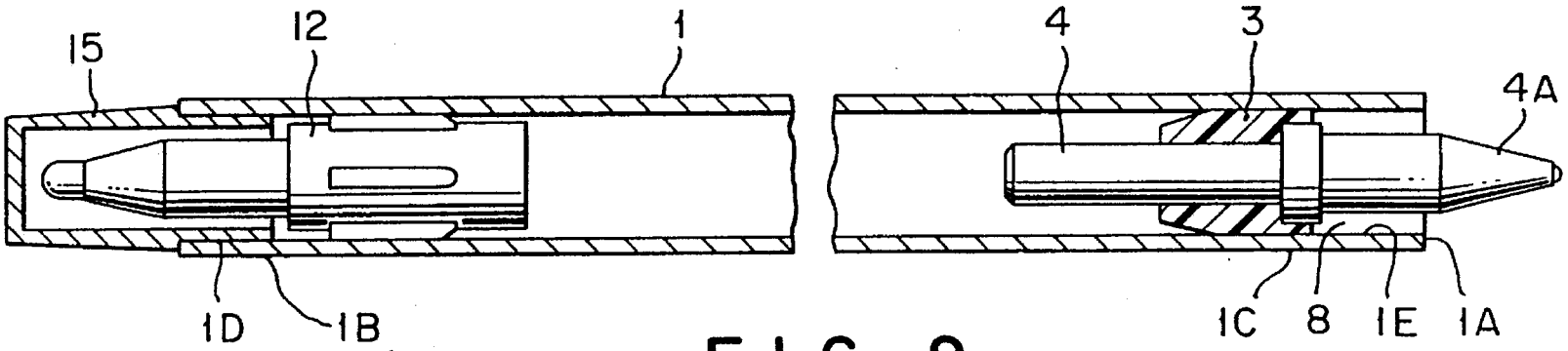
FIG. 9 is a longitudinal sectional view of the input pen with attached writing implement of FIG. 7, showing a state in which a ball-point pen is used.

In another embodiment of the present invention shown in FIG. 7, an input member 12 made of a plastic such as nylon is pushed into and affixed to a front portion of a cylindrical body 1 formed in a pipe shape and of a metal such as stainless steel. A front portion of the input member 12 has an input tip 12C and protrudes by a suitable amount from the front end of the cylindrical body 1, and a suitably-sized indented or recessed space 7 for allowing the engagement of a cap 15 is formed between a forward inner peripheral surface 1D of the cylindrical body 1 and the input member 12. A fixing member 3 made of a plastic or metal material is pushed into and affixed to a rearward inner peripheral surface 1E of the cylindrical body 1, and a base portion of a ball-point pen 4 is removably mounted in the fixing member 3. A writing portion 4A of this ball-point pen 4 protrudes by a suitable amount from a rear end 1A of the cylindrical body 1. The cap 15 of a diameter smaller than the outer diameter of the cylindrical body 1 is engaged with the rearward inner peripheral surface 1E of the cylindrical body 1 so that the writing portion 4A of the ball-point pen 4 is covered thereby. The cap 15 is formed with a protrusion 15A protruding outward from an outer peripheral surface of an inner portion thereof, as shown in FIG. 8, and this protrusion 15A engages with the rearward inner peripheral surface 1E of the cylindrical body 1. When the ball-point pen 4 is in use, the front portion of the cap 15 engages with the forward inner peripheral surface 1D of the cylindrical body 1.

Mention of a clip was omitted from the description of the embodiment shown in FIG. 7, in order to simplify it, but it should be obvious to those skilled in the art that various different types of clip that are provided for prior-art writing implements can be affixed thereto.

Since the cap 15 of above-described input pen with attached writing implement of FIG. 7 engages with either the rearward inner peripheral surface 1E or the forward inner peripheral surface 1D of the cylindrical body 1, there is no need to provide a step or protrusion for the engagement of the cap on the forward outer peripheral surface 1B and rearward outer peripheral surface 1C of the cylindrical body 1, and thus the pen has the advantage of being easy to hold when the cylindrical body 1 is held so that either the input pen or the ball-point pen 4 is used.

In addition, since the cap 15 engages with the cylindrical body 1, there is a further advantage that, when the cap 15 is removed, it is separated from the ball-point pen 4 and there is absolutely no liklihood of the input member 12 being damaged thereby when the cap 15 is fitted on the input member 12.

With the above described input pen with attached writing implement of the present invention, the cap can be attached when either the input pen is used or the writing implement is used, so that there is absolutely no likelihood of the cap becoming lost.

In addition, since the cap is formed to have a diameter smaller than that of the cylindrical body, there is no need to worry about it coming into contact with other objects and being removed thereby.

Since the cap does not engage with the outer surface of the cylindrical body, there is no need to provide a step or protrusion for the engagement of the cap on the outside of the cylindrical body, making the cylindrical body easy to hold when either the input pen or the ball-point pen is being used.

What is claimed is:

1. A writing instrument, comprising:

a cylindrical body (1) having a front end and a rear end;

an input member (2) fixed to said front end of said cylindrical body (1), said input member having a front portion (2B) formed with a tip portion (2C) for pressure-sensitive handwriting, said front portion (2B) protruding forward from said front end of the cylindrical body and having a diameter smaller than the diameter of the cylindrical body, said tip portion (2C) extending forward from the front portion (2B);

a fixing member (3) fixed within said rear end of said cylindrical body (1);

a writing means (4) such as a ballpoint pen held in said fixing member (3) in a removable manner, said writing means (4) having an engagement portion (4B) and a writing portion (4A), said engagement portion (4B) protruding backward from a rear end of the cylindrical body (1) and having a diameter equal to said diameter of said front portion (2B), said writing portion (4A) protruding backward from said engagement portion (4B); and a cylindrical cap (5) having an inner diameter equal to said diameters of said front portion (2B) and said engagement portion (4B), said cap (5) being removably and snugly fitted on an outer surface of said engagement portion (4B) to enclose and protect said writing portion (4A), said cap (5) being removably and snugly fitted on an outer surface of said front portion (2B), said cap (5) having an outer diameter less than the outer diameter of the cylindrical body (1).

2. The writing instrument as claimed in claim 1, further comprising means defining an annular indented space (8) provided in said rear end of the cylindrical body (1), said indented space (8) receiving therein an open end of said cap (5) fitted on said engagement portion (4B).

3. The writing instrument as claimed in claim 1, further comprising an annular connecting flange (2D) formed on said input member (2) for abutting engagement with said front end of the cylindrical body (1).

4. The writing instrument as claimed in claim 1, wherein said cap (5) has an inwardly directed protrusion (5A) thereon, said protrusion (5A) being removably engageable with said engagement portion (4B) to protect said writing portion (4A), said protrusion (5A) being removably engageable with said front portion (2B) of said input member.

5. A writing instrument, comprising:

a cylindrical body (1) having a front end and a rear end;

an input member (12) fixed in said front end of said cylindrical body (1), said input member having a front portion formed with a tip portion (12C) for pressure-sensitive handwriting, said front portion protruding forward from said front end of the cylindrical body and having a diameter smaller than the diameter of the cylindrical body, said tip portion (12C) extending forward from the front portion (2B);

a fixing member (3) fixed within said rear end of said cylindrical body (1);

a writing means (4) such as a ballpoint pen held in said fixing member (3) in a removable manner, said writing means (4) having a writing portion (4A), said writing portion (4A) protruding backward from said rear end of the cylindrical body and having a diameter smaller than said diameter of the cylindrical body (1); and a cylindrical cap (15), having at least a portion with an outer diameter equal to an inner diameter of said front end of said cylindrical body and to an inner diameter of said rear end of said cylindrical body, said cap (15) being removably and snugly fitted in said rear end of the cylindrical body (1) so as to enclose and protect said writing portion (4A), said cap (15) being removably and snugly fitted in said front end of the cylindrical body (1) to enclose and protect said front portion and tip portion (12C), said cap (15) having an outer diameter less than the outer diameter of the cylindrical body (1).

6. A writing instrument as claimed in claim 5, further comprising means defining an annular indented space (8) provided in said rear end of said cylindrical body, said indented space (8) receiving therein an open end of said cap (15) fitted in said rear end of the cylindrical body (1).

7. The writing instrument as claimed in claim 5, further comprising an annular recessed space (7) provided in said front end of said cylindrical body, said recessed space (7) receiving therein an open end of said cap (15) fitted in said front end of the cylindrical body (1).

8. The writing instrument as claimed in claim 5, wherein said cap (15) has an outwardly directed protrusion (15A) thereon, said protrusion (15A) being removably engageable with a rearward inner peripheral surface (1E) of said cylindrical body (1), said protrusion (15A) also being removably engageable with a frontward inner peripheral surface (1D) of said cylindrical body (1).

* * * * *